US005823159A

United States Patent [19]

Ariga

[11] Patent Number: 5,823,159

[45] Date of Patent: Oct. 20, 1998

[54] INDEPENDENT VALVE TRAIN LUBRICATION SYSTEM

[75] Inventor: Susumu Ariga, San Antonio, Tex.

[73] Assignee: Southwest Research Institute, San Antonio, Tex.

[21] Appl. No.: 938,625

[22] Filed: Sep. 26, 1997

[51] Int. Cl.[6] ..... F01M 9/10

[52] U.S. Cl. ..... 123/196 AB; 123/196 M; 123/90.33

[58] Field of Search ..... 123/196 R, 196 S, 123/196 M, 196 AB, 90.33–90.38

[56] References Cited

U.S. PATENT DOCUMENTS

| | | | |
|---|---|---|---|
| 3,782,357 | 1/1974 | Kuhn et al. | 123/196 S |
| 4,248,293 | 2/1981 | Kamezski et al. | 165/51 |
| 4,392,463 | 7/1983 | Yasuhara | 123/196 M |
| 4,541,368 | 9/1985 | Castarede | 123/196 AB |
| 4,745,896 | 5/1988 | Schultz | 123/196 |
| 4,854,276 | 8/1989 | Elsbett et al. | 123/196 AB |
| 4,940,114 | 7/1990 | Albrecht | 123/196 AB |
| 4,995,448 | 2/1991 | Inagaki et al. | 123/196 AB |
| 5,168,845 | 12/1992 | Peaker | 123/196 S |
| 5,195,474 | 3/1993 | Urata et al. | 123/90.12 |
| 5,220,892 | 6/1993 | Boemer | 123/196 AB |
| 5,267,537 | 12/1993 | Suzuki et al. | 123/90.38 |
| 5,526,783 | 6/1996 | Ito et al. | 123/196 S |
| 5,606,937 | 3/1997 | Calhoun | 123/196 AB |

FOREIGN PATENT DOCUMENTS 54-19028 2/1979 Japan .

*Primary Examiner*—Erick R. Solis
*Attorney, Agent, or Firm*—Jenkens & Gilchrist

[57] ABSTRACT

A heat exchanger is provided in an oil recirculation system that is exclusively dedicated to providing lubrication of the valve train in an overhead cam engine. The flow rate of oil through the heat exchanger is controlled to maintain the temperature of oil disposed in a reservoir formed in an enclosure in which the overhead cam and associated valve train components are mounted, at a value sufficient to assure a sufficiently thick oil film between sliding components of the overhead cam valve train under high surface contact loads.

8 Claims, 1 Drawing Sheet

INDEPENDENT VALVE TRAIN LUBRICATION SYSTEM

BACKGROUND OF THE INVENTION

1. Technical Field

This invention relates generally to a lubrication system for the valve train of an internal combustion engine, and more particularly to such a lubrication system that is separate and independent of the lower block lubrication system of the engine.

2. History of Related Art

In both spark-ignition and compression ignition internal combustion engines, valve train friction generally increases as speed decreases. Transportation vehicles are commonly operated under low load and low speed conditions. Therefore, the contribution of valve train friction to total engine friction is high at low engine speeds, in comparison with the friction contribution of other components in the engine. Consequently, a reduction in friction between valve train components significantly contributes to a reduction in total engine mechanical friction, and the gain in fuel economy, attributable to reduced valve train friction, becomes significant.

A major contributor to high valve train friction at low engine speeds, particularly in overhead cam engines, is the increased asperity contact load between sliding components, such as the cam and follower. At low speed, it is difficult to generate sufficient oil film thickness between the sliding components, particularly when the engine is operated under the high loads that often accompany low speed operation. Oil film thickness is sensitive to oil viscosity, increasing approximately with the square root of the viscosity of the lubricating oil. Therefore, the valve train should desirably be lubricated with a high viscosity oil.

However, in conventional internal combustion engines, the engine uses a specific oil that is designed to perform adequate lubrication for all engine components, regardless of specific operating and sliding contact surface conditions. For example, the piston and ring assembly requires a low viscosity lubricant to maintain low engine friction whereas, as noted above, components under high surface contact load the valve train should be lubricated with a relatively high viscosity oil to maintain film thickness and reduce friction. Oil has been developed to achieve the best possible compromise that, at least partially, satisfies the minimum requirements of all components of an engine. For example, oil additives such as friction modifiers, have been effective in reducing valve train friction without increasing the viscosity. Also, a separate oil supply system for the valve train of an internal combustion engine is described in U.S. Pat. No. 5,195,474, issued Mar. 23, 1993 to Yasuhiro Urata, et al. Urata proposes using a silicone-based lubricant that is less susceptible to viscosity decrease with an increase in temperature, to lubricate the valve train system of an engine. However, even with this system, there is still a general decrease in viscosity with an increase in temperature, with a resultant reduction in the ability of the lubricant to maintain a desirable film thickness between sliding components of the valve train system.

In the future, engine friction will need to be reduced to a substantially lower level than that of current production engines. More stringent requirements for fuel economy and lower exhaust emissions require a substantial reduction in internal engine friction. Since, as described above, the valve train friction contribution under vehicle road load conditions is high, valve train friction in particular needs to be reduced.

The present invention is directed to overcoming the problems set forth above. It is desirable to have a valve train lubrication system for use in an overhead cam engine that is separate from the lubrication system for the lower block components of the engine. It is also desirable to have such a valve train lubrication system which is capable of maintaining the lubricating oil for the valve train system at a desired temperature and, accordingly, at a desired viscosity value. Furthermore, it is desirable to have such an independent valve train lubrication system for an overhead cam engine that, as a result of providing decreased valve train friction, contributes to a decrease in fuel consumption. In addition, it is desirable to have such an independent valve train lubrication system that extends the life of the oil used for lubrication of the valve train as a result of keeping the valve train lubrication oil separate from that of the lower block lubrication system.

SUMMARY OF THE INVENTION

In accordance with one aspect of the present invention, a valve train lubrication system for an internal combustion engine includes an oil reservoir disposed in the lower portion of a cavity defined by a portion of the cylinder head of the engine and a valve cover. An overhead cam valve train is disposed within the cavity. The valve train lubrication system further includes an oil pump in fluid communication with the oil reservoir, a drain conduit in fluid communication with the oil reservoir, a heat exchanger in fluid communication with the drain conduit and the oil pump, and a means for controlling the flow rate of oil through the heat exchanger.

Other features of the valve train lubrication system embodying the present invention include the means for controlling the flow rate of oil through the heat exchanger being a temperature sensor arranged to sense the temperature of oil in the oil reservoir, a flow control valve in fluid communication with the heat exchanger, and an electronic control unit in electrical communication with the temperature sensor and the flow control valve. Additional features of the lubrication system include the oil pump being driven by an electric motor, a flow control valve disposed in the drain conduit at a position between the oil reservoir and the heat exchanger, and the electronic control unit being in electrical communication with the temperature sensor and the flow control valve. Still another feature of the valve train lubrication system includes a filter disposed between the heat exchanger and the pump.

In another aspect of the present invention, an engine includes an oil reservoir disposed in a lower portion of an enclosed cavity defined by a portion of the cylinder head of the engine and by a valve cover. A plurality of engine valves, actuated by cam surfaces disposed on a cam shaft mounted upon the cylinder head, are rotatably disposed within the cavity. The engine further includes a means for controlling the temperature of oil disposed in the oil reservoir disposed in the defined enclosed cavity.

Other features of the engine include the means for controlling the temperature of oil disposed in the oil reservoir being an oil pump in fluid communication with the oil reservoir, a drain conduit in fluid communication with the oil reservoir, a heat exchanger in fluid communication with the drain conduit, and the oil pump, a flow control valve in fluid communication with the heat exchanger, a temperature sensor arranged to sense the temperature of oil in the oil reservoir, and an electronic control unit in electrical communication with the temperature sensor and the flow control valve. Other features include a flow control valve being disposed in the drain conduit at a position between the oil reservoir and the heat exchanger. Still other features include the pump being driven by an electric motor in electrical communication with the electronic control unit, and a filter disposed between the heat exchanger and the pump.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF PRESENTLY PREFERRED EXEMPLARY EMBODIMENTS

Figure 1:
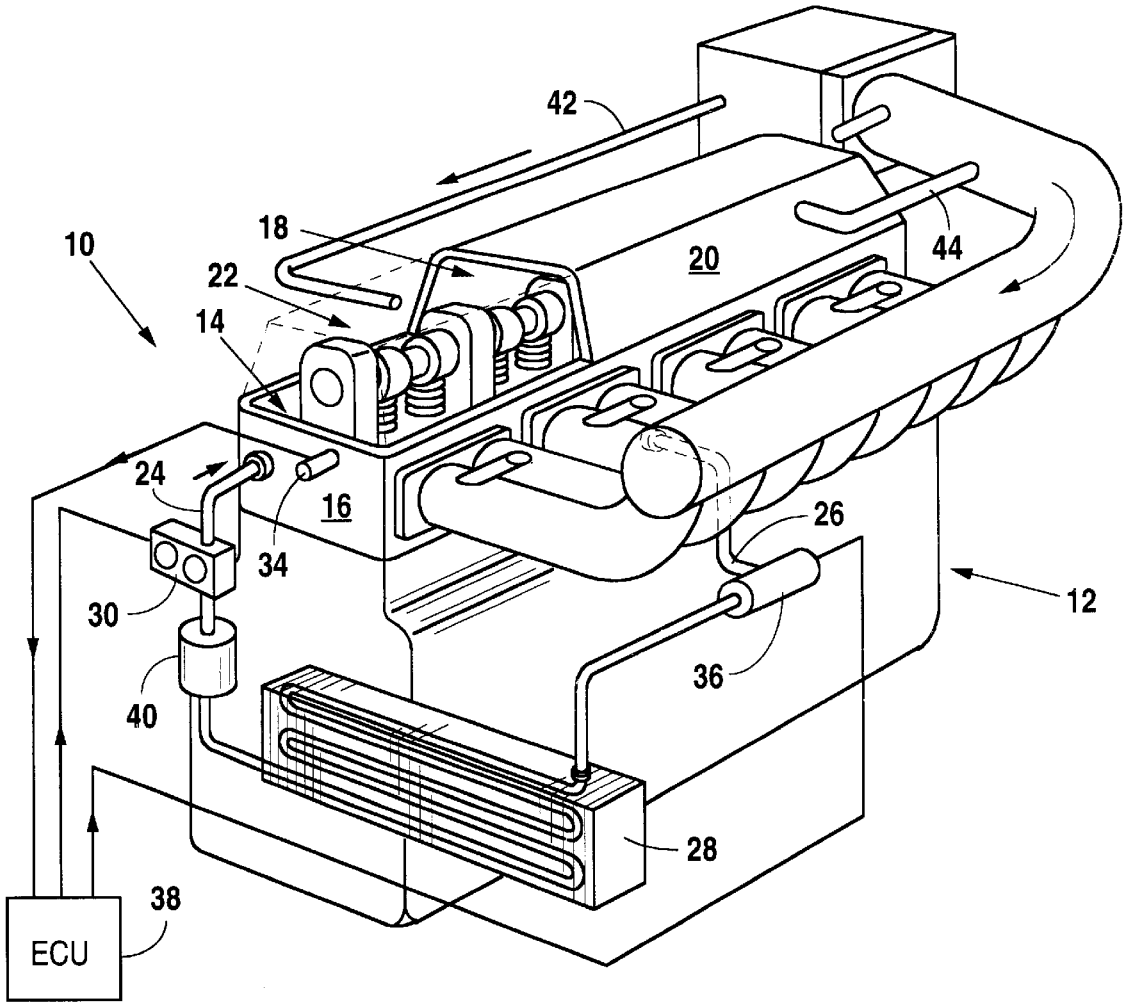
FIG. 1 is a three-dimensional schematic view of an overhead cam engine having a valve train lubrication system embodying the present invention.
Figure 2:
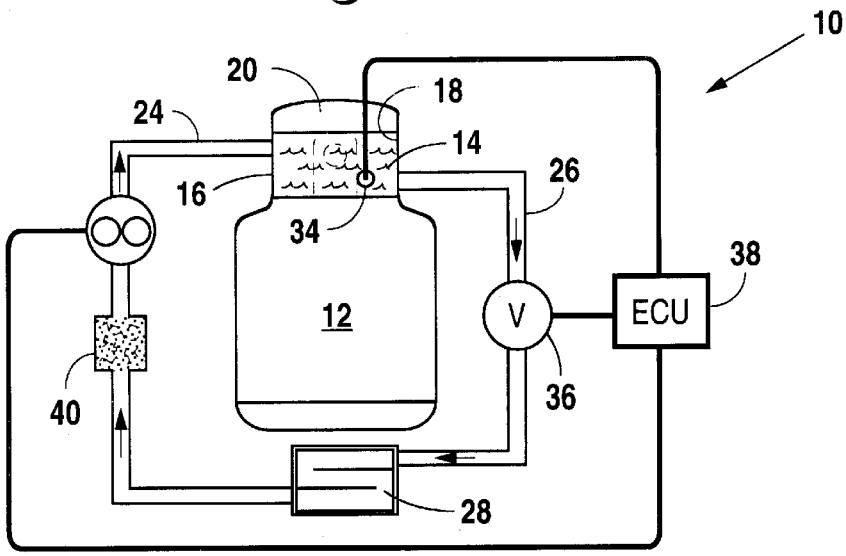
FIG. 2 is a schematic diagram of the valve train lubrication system embodying the present invention.

In the preferred embodiment of the present invention, as illustrated in FIG. 1, a valve train lubrication system 10 for an overhead cam engine 12 has an oil reservoir 14 that is formed within an upper portion of the cylinder head 16 of the engine 12. The oil reservoir 14 is thus disposed in a lower portion of an enclosed cavity 18 defined by the upper portion of the cylinder head 16 and a valve cover 20. The overhead cam components 22, for example, a cam shaft, cam lobe surfaces formed on the cam shaft, and follower surfaces of the valves, are disposed within the cavity 18 and lubricated by splash deposition of oil onto opposed sliding surfaces of the overhead cam components 22. Alternatively, internal oil supply passageways formed in the overhead cam structure may deliver lubricating oil directly from a supply conduit 24, onto the interfacing surfaces of the cam components 22, and then drained into the reservoir 14. Oil drained from the reservoirs 14 is directed, by way of a drain conduit 26, to a heat exchanger 28 which cools the oil used to lubricate the valve train in the overhead cam engine 12.

Oil drained from the oil reservoir 14 is passed through the heat exchanger 28 and recirculated into the oil reservoir 14 by way of a pump 30. The pump 30, as shown schematically in FIG. 1, may be positioned outside of the enclosed cavity 18 and driven by an electric motor or by a mechanical drive coupled to the engine. Alternatively, the pump 30 may be disposed within the enclosed cavity 18 and be mechanically driven by the cam shaft.

The valve train lubrication system 10 further includes a means for controlling the flow rate of oil through the heat exchanger 28. The flow rate control means includes a temperature sensor 34 that is arranged to sense the temperature of oil in the oil reservoir 14, a flow control valve 36 that is located in the drain conduit 26 between the oil reservoir 14 and the heat exchanger 28, and an electronic control unit 38 that is in electrical communication with the temperature sensor 34 and the flow control valve 36. The electronic control unit 38 may be a conventional programmable controller or a dedicated circuit in a conventional automotive type electronic control unit as used to control various engine operating parameters. Desirably, the electronic control unit 38 is also in electrical communication with the pump 30 to turn the pump off when the flow control valve 36 is closed.

The rate of oil flow through the heat exchanger 28 is controlled by the electronic control unit 38 in response to a sensed temperature signal from the temperature sensor 34. Typically, upon engine startup, or when the lubrication oil is otherwise below a preselected temperature, oil is not recirculated through the heat exchanger 28 so that the designed operating oil temperature, consistent with the viscosity characteristics of the oil in the oil reservoir 14, can be quickly reached. When the oil reservoir 14 temperature reaches the desired operating temperature, the valve 36 is opened, and the pump 38 is actuated to recirculate oil through the heat exchanger 28 and into the reservoir 14. The oil flow rate through the heat exchanger 28 is regulated by the position of the flow control valve 36 and/or the output flow rate from the pump 30 to maintain the temperature of the oil in the reservoir 14 within a desired operating range. That is, oil flow rate will increase in response to an increase in oil temperature, and decrease in response to lower reservoir temperature to maintain the oil in the reservoir at a temperature within a desired range and, accordingly, within a controlled viscosity range.

Desirably, a filter 40 is disposed between the heat exchanger 28 and the pump 30. This will assure that any debris or metal particles that may be carried by the recirculated oil are trapped within the filter 40, and not recirculated through the pump 30 and the overhead cam components 22.

In an alternative embodiment, the flow control valve 36 may comprise a two-way valve to selectively direct oil from the reservoir 14 either through the heat exchanger 28, as shown in FIG. 1, or to a by-pass conduit whereby all or a portion of the recirculated flow is directed around the heat exchanger 28. In this embodiment, a by-pass conduit extends between a second outlet port of the flow control valve 36 and the supply conduit 24 upstream of the filter 40. The alternative arrangement permits selectively cooling only a portion of the recirculated oil, i.e passing only a portion of the recirculated oil through the heat exchanger 28, while maintaining a constant flow recirculation flow rate. For example, it may be desirable to begin recirculation of the oil in the reservoir 14 at the time the engine is started, prior to the oil reaching the predetermined desired operating temperature. During that time period, all of the oil in the valve train lubrication system would be recirculated through the filter 40 and the pump 30, but would by-pass the heat exchanger 28. Thus, the valve train lubrication system 10 provides a means for controlling the temperature of oil disposed in the oil reservoir 14, either using a single outlet port flow control valve 36, or a dual outlet port valve.

The heat exchanger 28 may comprise a conventional oil cooler located in tandem with the engine coolant radiator as often found in transmission fluid heat exchangers, or positioned at any other location in the engine compartment where a flow of air, or engine coolant, could pass through the heat exchanger 28 and cool the oil being recirculated through the exchanger 28.

Although shown in the drawings as a single overhead cam arrangement, the present invention is equally applicable to double or multi-overhead cam arrangements disposed within the same cavity.

Although not a part of the valve train lubrication system 10, an inlet vent line 42 and a discharge vent line 44, both in fluid communication with the intake air duct or manifold of the engine 12, may be connected through the valve cover 20 to the enclosed chamber 18, as shown in FIG. 1, to supply fresh air into the enclosed chamber 18 and evacuate vapors from the valve train atmosphere. This arrangement is similar to a conventional positive crank case ventilation (PCV) system. Therefore, it is possible to integrate the valve train ventilation system 10 with current PCV systems.

Furthermore, since the oil used for the valve train lubrication does not mix with the oil used for lubrication of the engine block, more specifically the interior of the cylinders and pistons, the crank shaft and the connecting rods, the valve train is lubricated by oil that does not contain contaminants such as products of combustion, acid irons, fuel, and other undesirable compounds. Therefore, the oil used for the valve train has a longer service life and valve train durability improves. Furthermore, since the oil within the valve train lubrication system is maintained within a predetermined temperature range, the lubricating oil can be selected so that it has a desired viscosity within the controlled temperature range and is thus capable of maintaining a desired oil film thickness under high surface contact loading.

Although the present invention is described in terms of preferred exemplary embodiments, with specific illustrative arrangements of the pump, heat exchanger, flow control valve, filter and reservoir components, those skilled in the art will recognize that changes in those arrangements may be made without departing from the spirt of the invention. Such changes are intended to fall within the scope of the following claims. Other aspects, features, and advantages of the present invention may be obtained from the study of this disclosure and the drawings, along with the appended claims.

What I claim is:

1. A valve train lubrication system for an internal combustion engine having a cylinder head, a plurality of engine valves actuated by a camshaft mounted above the cylinder head wherein said camshaft is rotatable disposed within an enclosed cavity having a lower portion defined by a portion of said cylinder head and an upper portion defined by a valve cover, said valve train lubrication system being mutually exclusive of an engine lubrication system providing lubrication to the interior of the cylinders, pistons, crankshaft and connecting rods of the engine, and comprising:

an oil reservoir disposed in a lower portion of said enclosed cavity;

an oil pump in fluid communication with said oil reservoir;

a drain conduit in fluid communication with said oil reservoir;

a heat exchanger in fluid communication with said drain conduit and with said oil pump;

a temperature sensor arranged to sense the temperature of oil in said oil reservoir;

a flow control valve in fluid communication with said heat exchanger; and an electronic control unit in electrical communication with said temperature sensor and said flow control valve.

2. A valve train lubrication system, as set forth in claim 1, wherein said flow control valve is disposed in said drain conduit at a position between said oil reservoir and said heat exchanger.

3. A valve train lubrication system, as set forth in claim 1, wherein said pump is driven by an electric motor and said electronic control unit is in electrical communication with said electric motor.

4. A valve train lubrication system, as set forth in claim 1, wherein said system includes a filter disposed between said heat exchanger and said pump.

5. An engine having a cylinder head, a plurality of engine valves actuated by cam surfaces disposed on a camshaft mounted above the cylinder head and rotatably disposed within an enclosed cavity having a lower portion defined by a portion of said cylinder head and an upper portion defined by a valve cover, a first engine lubrication system providing lubrication to the interior of the cylinders, pistons, crankshaft and connecting rods of the engine, and a second lubrication system separate from said first engine lubrication system and arranged to provide lubrication of mutually contacting surfaces of said valves and said cams disposed on the camshaft, said second lubrication system comprising:

an oil reservoir disposed in a lower portion of said enclosed cavity defined by a portion of said cylinder head and by said valve cover;

an oil pump in fluid communication with said oil reservoir;

a drain conduit in fluid communication with said oil reservoir;

a heat exchanger in fluid communication with said drain conduit and with said oil pump;

a flow control valve in selective fluid communication with said heat exchanger;

a temperature sensor arranged to sense the temperature of oil in said oil reservoir; and an electronic control unit in electrical communication with said temperature sensor and said flow control valve.

6. An engine, as set forth in claim 5, wherein said flow control valve is disposed in said drain conduit at a position between said oil reservoir and said heat exchanger.

7. An engine, as set forth in claim 5, wherein said pump is driven by an electric motor and said electronic control unit is in electrical communication with said electric motor.

8. An engine, as set forth in claim 5, wherein said engine includes a filter disposed between said heat exchanger and said pump.

* * * * *